US005123308A

United States Patent [19]

Shaffer

[11] Patent Number: 5,123,308

[45] Date of Patent: Jun. 23, 1992

[54] TORQUE MULTIPLYING LUG NUT WRENCH

[75] Inventor: James E. Shaffer, Maitland, Fla.

[73] Assignee: Consulier Engineering, Inc., Riviera Beach, Fla.

[21] Appl. No.: 593,205

[22] Filed: Oct. 5, 1990

[51] Int. Cl.[5] ..... B25B 17/00

[52] U.S. Cl. ..... 81/57.31; 81/56

[58] Field of Search ..... 81/55, 56, 57.31, 467

[56] References Cited

U.S. PATENT DOCUMENTS 2,537,382 1/1951 Valentin ..... 81/56

2,550,542 4/1951 Factly ..... 81/56

*Primary Examiner*—James G. Smith

*Attorney, Agent, or Firm*—Warren L. Franz

[57] ABSTRACT

A compact, torque multiplying apparatus for turning nuts of wheel lugs has an orbiting gear arrangement including an epicycling gear element driven within a housing by a socket wrench. In one case, the housing is held fixed by a tool that mates with adjacent wheel rim contours and output torque is applied to a lug nut by rotation of a second gear element. In another case, the second gear element is held fixed by keying it to the end of the lug, and output torque is transmitted to the nut by the housing.

19 Claims, 1 Drawing Sheet

TORQUE MULTIPLYING LUG NUT WRENCH

This invention relates to apparatus for facilitating the loosening or tightening of a lug nut onto a wheel hub lug during removal or mounting of a wheel; and, in particular, to compact wheel-braced, torque multiplying apparatus means for accomplishing the same.

BACKGROUND OF THE INVENTION

Tire-carrying wheels for motor vehicles and the like are attached to an axle hub or brake drum of the vehicle body by passing heavy threaded bolts called lugs through holes in the wheel and tightening the wheel thereto using wheel or lug nuts. Proper wheel nut torque for attachment of automobile wheels is typically 95–100 ft.-lbs. (129–140 Nm). Using conventional L-shaped lug nut wrenches, considerable strength is required to achieve such torque. Even with the long handle, the length of the achievable force application moment is limited. Moreover, there is a propensity for the nut receiving box end of the wrench to unseat during manipulation of the arm, which may undesirably damage chrome capped and similar wheel nuts.

One problem with the interposition of any gearing mechanism to mechanically provide the same effect as a larger moment without extending the wrench handle length, is the need to fix rotation of the mechanism relative to rotation of the nuts. To accomplish this by means requiring contact with the ground maintains some of the disadvantages inherent in the long arm of the current wrench.

It is an object of the present invention to provide compact wheel-braced, torque multiplying apparatus for facilitating the loosening or tightening of the lug nuts of a motor vehicle wheel or the like.

In accordance with one aspect of the invention, a compact mechanical assembly is provided having input means for receiving a torque applied by a lever arm, gear means for multiplying the applied torque, and output means for applying the thus multiplied torque to a lug nut of a wheel. Means are further provided to brace a stator portion of the gear means to fix the same relative to the wheel or lug.

In an illustrative embodiment of the invention, described in greater detail below, the gear means comprises an eccentrically driven orbiting gear set, wherein a first cylindrical gear element serving as the input means functions as an epicycling coupling between a tubular housing and a second cylindrical gear element which is axially-spaced from the first element and concentrically located within the housing to serve as the output means. A bracing member located nonrotationally annularly of the housing is configured to fix the housing against rotation between the outside of the axle hole rim and the inside rim of the wheel.

In a modified embodiment, the assembly is braced internally by keying the second gear element to the lug to act as the stator, and configuring the housing to act as the output means for rotating the nut.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DETAILED DESCRIPTION OF PREFERRED EMBODIMENTS

Figure 1:
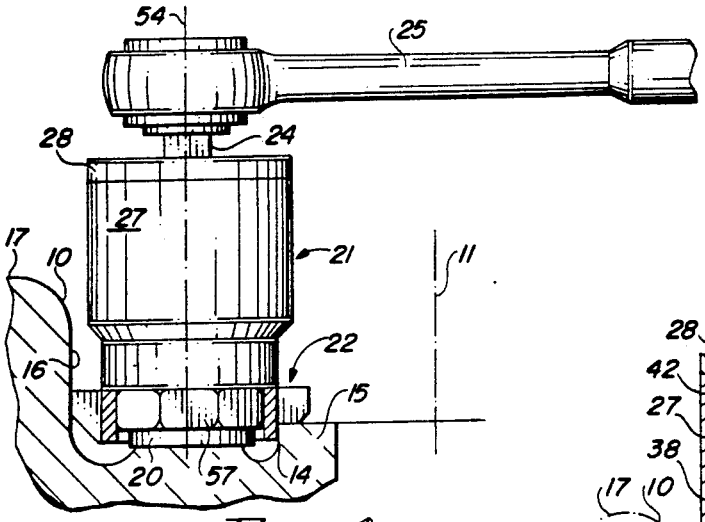
FIG. 1 is a side view of an embodiment of the apparatus of the invention shown in its application to apply torque to a lug nut of a wheel.
Figure 2:
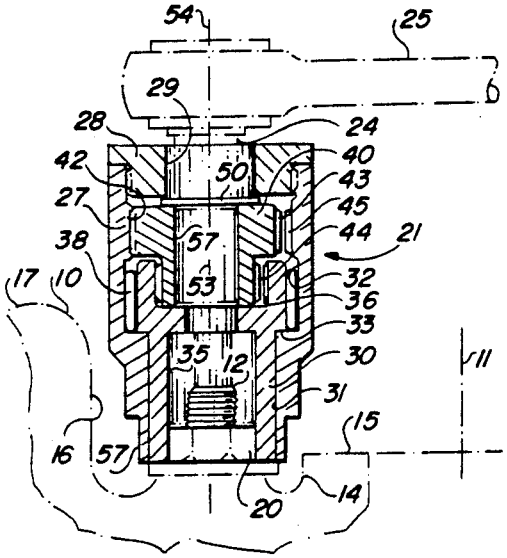
FIG. 2 is a longitudinal section view of the reducer assembly of the apparatus of FIG. 1.

As shown in FIGS. 1 and 2, a wheel 10 of a motor vehicle or the like has a plurality of holes angularly-spaced about a center line 11 and through which lug bolts 12 (FIG. 2) may be extended for attachment of the wheel 10 to the vehicle. The bolt receiving holes are located on plateaus intermediate the outside diameter 14 of a central axle hole rim 15 and the inside diameter 16 of a concentric inner rim 17 of the wheel 10. Lug nuts 20 are threaded, cone-shaped end toward wheel 10, onto the lugs 12 to maintain the wheel in place.

In accordance with the invention, apparatus comprising a torque multiplying, reduction gear mechanism 21 (FIGS. 1 and 2) and a tool 22 for bracing the same relative to the wheel 10 (FIGS. 1 and 3) is provided for facilitating the loosening or tightening of the lug nuts 20. The unit 21 comprises input means for receiving a torque applied by a lever arm, gear means for multiplying the applied torque, and output means for applying the multiplied torque to a nut 20. The brace 22 comprises means to brace a stator portion of the gearing mechanism to fix its position against rotation relative to the wheel.

The embodiment of the unit 21 shown in FIGS. 1 and 2 is configured to multiply torque applied at an upper input end by rotation of a socket drive 24 of a conventional ratchet wrench 25.

The reduction gearing mechanism includes a tubular, stepped outside diameter housing 27 at an upper input end of which is threaded a journal element 28 having a central bore 29 of diameter larger than the largest dimension of the socket drive 24, so that the drive 24 may be inserted therethrough and rotated therein without obstruction. A lug socket 30 is concentrically received within the housing 27 at its lower output end.

The socket 30 has a stepped outside diameter, with a reduced section that fits within a lower reduced inside diameter portion 31 of a central bore of the housing 27 and an enlarged section that fits within a middle enlarged inner diameter portion 32 of the same housing bore. An annular shoulder 33 of the socket 30 restrains the socket 30 against downward axial movement within the housing 27. The bottom end of the socket 30 includes a central axial bore 35 of internal hexagonal cross-section to match and receive the external hexagonal cross-section of the nut 20. The bore 35 is sufficiently elongated in the axial direction to accommodate the projection of the lug 12 beyond the nut 20. The upper end of the socket 30 includes an axial cavity presenting an internally-facing toothed cylindrical gear surface 36. The socket 30 is rotatable relative within the housing 27 and a plurality of rollers 38 are provided between the enlarged outside diameter of the upper end of the socket 30 and the inside diameter of the housing bore portion 32 for purposes of reducing friction during relative rotation.

A stepped outside diameter cylindrical orbiting gear member 40 is located within the housing 27, intermediate the journal 28 and the socket 30. A reduced outside diameter lower portion of the orbiting gear 40 of diameter less than the inside diameter of the gear 36 is positioned within the upper end cavity of the socket 30. An enlarged outside diameter upper end portion of the gear member 40 is positioned above the socket 30 within a housing bore portion 42 of greater diameter than the outside diameter of that portion of the gear portion 40. Annularly located, angularly-spaced teeth on the upper portion of the gear 40 provide a first outwardly-facing cylindrical gear track 43, and similarly annularly located, angularly-spaced teeth on the lower part of the gear member 40 provide a second outwardly-facing, cylindrical gear track 44. Another gear track 45 which is internally-facing is provided on the inside diameter of the housing bore 42. The gear tracks 36, 44 and 45, 43 are configured to cooperate to provide dual sets of orbiting gears which function according to known mechanical principles. A circular bearing 50 provides a friction reducing retainer to prevent upward axial movement of the rotatable element 40.

The gear member 40 has an internal axial bore 51 having a cross-section dimensioned, configured and adapted to match a corresponding cross-section of the socket drive 24, so that the member 40 can be driven in epicyclic rotation, its rotary axis 53 being offset from the unit 21 center line 54.

Figure 3:
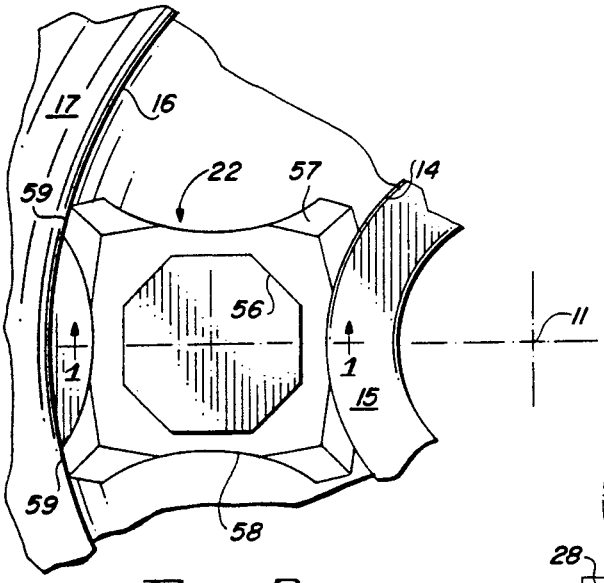
FIG. 3 is a top view showing the operation of the bracing member of FIG. 1.

The bracing tool 22, in accordance with a first embodiment of the invention, is shown in FIGS. 1 and 3. To achieve the gear reduction and, hence, the torque multiplication using the eccentrically driven orbiting gear set described above, means must be established to fix one of the gear tracks relative to the wheel 10 or the ground. For the shown embodiment, the gear track 45 is held fixed by releasably securing the housing 27 against rotation relative to the wheel 10. This is accomplished by keying a bore 56 (FIG. 3) of the tool 22 to the outside diameter of a lower portion 57 (FIG. 1) of the housing 27, and providing means to prevent rotation of the tool 22.

As shown in FIG. 1, the portion 57 of the housing 27 can be given an externally octagonal cross-section to match a corresponding internally octagonal cross-section given to the bore 56. The outside of tool 22 can then be configured to match both the contour of the outside diameter 14 of the axle hole rim 15 and simultaneously the contour of the inside diameter 16 of the wheel rim 17. One way of accomplishing this, as shown in FIG. 3, is to provide the brace 22 with four equally angularly-spaced radial extensions or legs 57 and arcuate indentations 58 located therebetween. The extremities of the legs 57 at 59 are rounded and configured to match the curvature of the rim 16. The arcuate indentations 58 are configured to match the curvature of the outside diameter 14 of the axle hole rim 15. With two legs 57 contacting the rim 17, as shown in FIG. 3, and one arcuate recess 58 contacting the rim 15, the housing 27 keyed to the bracing tool 22 is prevented from rotating with the rotation of orbiting gear member 40.

A first gear reduction occurs between the gear tracks 43, 45 which may be 18 teeth and 13 teeth, or other tooth ratios, respectively. A second gear reduction occurs between the gear tracks 36 and 44 which may be 13 teeth and 11 teeth, or other tooth ratios, respectively. The reduction that occurs will be a function of the tooth ratios and the relative diameters of the tracks.

In operation, the bore 56 of the bracing tool 22 is matched to the outside contour of the lower portion 57 of the reduction mechanism housing 27 (FIG. 1). The brace 22 is then positioned between the rims 15 and 17, as shown in FIG. 3, with the bore 35 of the lower end of the member 21 placed over one of the nuts 20 (FIG. 2). The socket drive 24 of the wrench 25 is then passed through the bore 29 of the journal 28 and into the matching bore 57 of the gear member 40. As the drive 24 is turned, it turns the gear member 40 which interacts by means of the gear tracks 43, 45 and 36, 44 to multiply the applied torque and turn the socket 30 to loosen or tighten the nut 20. The housing 27 does not rotate because it is keyed to the brace 22 that is prevented by rims 15 and 17 from rotating.

Figure 4:
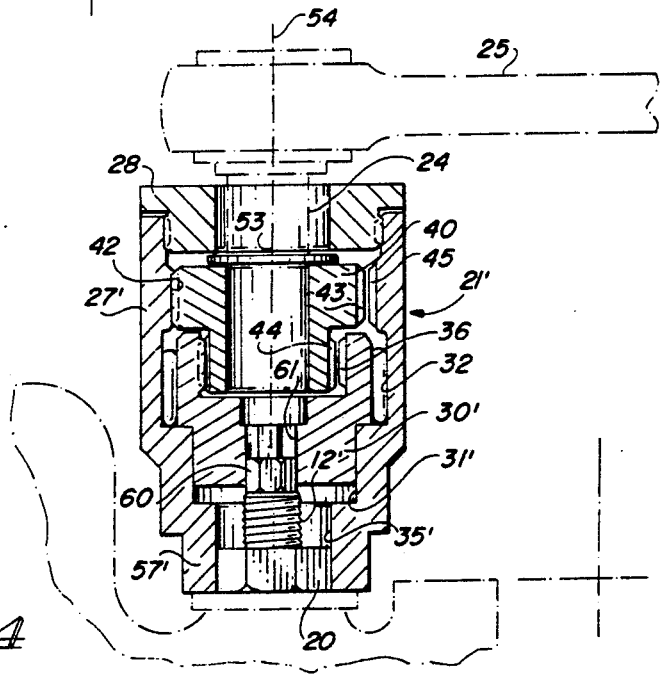
FIG. 4 is a view corresponding to that of FIG. 2 of a modified embodiment of the invention.

A modified embodiment of the invention is illustrated by the apparatus 21' shown in FIG. 4. Apparatus 21' is designed for turning a lug nut 20 fitted to a lug 12' which has an unthreaded, reduced diameter shank end 60 of non-circular external cross-sectional configuration. In contrast to the embodiment 21 of FIGS. 1–3, the apparatus 21' is configured to be braced internally by keying it to the shank end 60, so no external bracing tool 22 is required.

Unit 21' has a housing 27' (FIG. 4) that differs from housing 27 of unit 21 (FIG. 2) at its lower end 57'. End 57' has a central bore 35', of smaller inside dimension than the bore 31 of unit 21, and which has an internal hexagonal cross-section dimensioned, configured and adapted to match and receive the external hexagonal cross-section of the nut 20. To this extent, the bore 35' serves the same purpose as the bore 35, described above, of the lug socket 30 of unit 21. The function of bore 31 of housing 27 is served in a modified way in housing 27' by a bore portion 31', of diameter larger than the diameter of portion 35' and which corresponds to the upper region of the bore 31 of the housing 27. Housing 27' also includes bore portions 32, 42 equivalent to the same numbered portions of housing 27, above.

A first gear element 40 identical with the orbiting gear member 40 located within housing 27 of unit 21 is similarly located within housing 27' of 21'. A second gear element 30', which is an axially shortened version of lug socket 30, occupies a position within housing 27' similar to that occupied by socket 30 in housing 27. The lower end of element 30' is, however, cut off so that there is no contact between the element 30' and the nut 20. In addition, the bore 35 of socket 30 has been replaced in element 30' by a much smaller axial bore 61.

Element 30 is located within housing 27' and bore 61 is internally configured so that the interior of bore 61 can be matched to the exterior of shank end 60 at the same time that the interior of bore 35' is matched to the exterior of nut 20. FIG. 4 shows the interior of bore 61 hexagonally configured to mate with a matching hexagonal contour of shank end 60. The keying relationship thus established between the element 30' and the lug end 60, serves a bracing purpose analogous to that of tool 22, above, i.e. to fix one of the gear tracks relative to the wheel 10 or the ground. In the case of unit 21, the gear track 45 is held fixed and tracks 36, 44, 43 are left rotatable; for unit 21', track 36 is held fixed and tracks 44, 43, 45 are left rotatable.

In operation, bore 35' at the lower end 57' of housing 27' is brought over a nut 20, with the upper end 60 of lug 12' keying into bore 61 of element 30'. Drive 24 of wrench 25 can then be turned to turn gear member 40 which interacts by means of the gear tracks 43, 45 and 36, 44 to multiply the applied torque, as before. With unit 21', however, element 30' remains fixed and housing 27′ rotates to apply the multiplied torque to the nut 20.

Those skilled in the art to which the invention relates will appreciate that other substitutions and modifications can also be made to the described embodiment without departing from the spirit and scope of the invention as described by the claims below.

What is claimed is:

1. Torque multiplying apparatus for applying torque to a nut of a lug of a wheel having a lug hole located between a first rim with an outside diameter and a second rim with an inside diameter, said apparatus comprising:

input means for receiving an externally applied torque;

gear means, including rotor and stator portions, connected to said input means for multiplying said applied torque;

output means connected to said gear means for applying said multiplied torque to the nut; and means, contacting said inner and outer diameters, for bracing said stator portion between said rims to fix said stator portion relative to said lug.

2. Torque multiplying apparatus for applying torque to a nut of a lug of a wheel and the like, said apparatus comprising:

input means for receiving an externally applied torque;

gear means, including rotor and stator portions, connected to said input means for multiplying said applied torque;

output means connected to said gear means for applying said multiplied torque to the nut; and means for bracing said stator portion to fix said stator portion relative to said lug;

said gear means comprising a tubular housing and first and second axially-spaced gear elements located within said housing; and said input means comprises means located at an input end of said first gear element for receiving a torque applied by a lever arm.

3. Apparatus as in claim 2, for applying torque to a nut of a lug having an end with a non-circular external cross-sectional configuration, wherein said bracing means comprises means for keying said stator portion to said lug end.

4. Apparatus as in claim 2, wherein said housing is said stator portion; said second gear element is said rotor portion; said output means comprises means located at an output end of said second gear element for applying said multiplied torque to said nut; and said bracing means comprises means for fixing said housing on said wheel.

5. Apparatus as in claim 2, wherein said housing is said rotor portion; said second gear element is said stator portion; said output means comprises means located at an output end of said housing for applying said multiplied torque to said nut; and said bracing means comprises means for fixing said second gear element on said lug.

6. Apparatus as in claim 2, wherein said input means comprises means for receiving a torque applied by a drive of a socket wrench.

7. Torque multiplying apparatus for applying torque to a nut of a lug of a wheel and the like, said apparatus comprising:

a tubular housing having a first gear surface;

input means for receiving an externally applied torque;

a first gear member rotatably located within said housing and having second and third gear surfaces;

a second gear member rotatably located within said housing axially-spaced from said first gear member and having a fourth gear surface; said first, second, third and fourth gear surfaces being cooperative for multiplying said externally applied torque;

output means located on one of said housing and second gear member for applying said multiplied torque to the nut; and bracing means on said other of said housing and second gear member for fixing said other of said housing and second gear member relative to said lug.

8. Apparatus as in claim 7, for applying torque to a nut having an externally hexagonal cross-section, wherein said output means comprises a bore on said one of said housing and second gear member which has an internally hexagonal cross-section to match said cross-section of the nut.

9. Apparatus as in claim 8, for applying torque to a nut of a lug of a wheel having a lug hole located between a first rim with an outside diameter and a second rim with an inside diameter, wherein said hexagonal bore is located on said second gear member, and wherein said bracing means comprises means located on said housing for contacting said inner and outer diameters to fix said housing relative to said lug.

10. Apparatus as in claim 9, wherein said housing includes a lower portion having an external configuration, and said bracing means comprises a tool having a bore with an internal configuration to match the external configuration of said lower portion so that said housing can be keyed to said tool.

11. Apparatus as in claim 10, wherein said tool comprises angularly-spaced radial extensions having extremities configured to match the curvature of said second rim inside diameter, and arcuate indentations located between said extensions and configured to match the curvature of said first rim inside diameter.

12. Apparatus as in claim 8, for applying torque to a nut of a lug having an end with a non-circular external cross-sectional configuration, wherein said hexagonal bore is located on said housing, and wherein said bracing means comprises a bore on said second gear member having a non-circular internal cross-sectional configuration to match the external configuration of said lug end so that said second gear member can be keyed to said lug end.

13. Apparatus as in claim 8, wherein said gear surfaces are cooperative so that a first gear reduction occurs between said first and second gear surfaces and a second gear reduction occurs between said third and fourth gear surfaces.

14. Apparatus as in claim 8, wherein said first gear surface is an inwardly-facing cylindrical gear track, said second gear surface is an outwardly-facing cylindrical gear track opposing said first gear track, said first track has an outside diameter, and said second track has an inside diameter less than said first track outside diameter.

15. Apparatus as in claim 8, wherein said input means comprises a bore located on said first gear member which has an internal cross-section to match an external cross-section of a drive element of a socket wrench.

16. Torque multiplying apparatus for applying torque to a nut of a lug of a wheel and the like, said apparatus comprising:

a tubular housing having an inwardly-facing first gear track;

a first gear member rotatably located within said housing and having outwardly-facing second and third gear tracks;

means located on an upper portion of said first gear member for receiving an externally applied torque;

a second gear member rotatably located within said housing axially-spaced from said first gear member and having an inwardly-facing fourth gear track; said first, second, third and fourth gear tracks being cooperative for multiplying said externally applied torque;

output means, comprising a bore having an internal cross-sectional contour to match an external cross-sectional contour of the nut and located on a lower portion of one of said housing and second gear member, for applying said multiplied torque to said nut; and bracing means, on said other of said housing and second gear member, for fixing said other of said housing and second gear member relative to said lug.

17. Apparatus as in claim 16, wherein said first, second, third and fourth gear tracks comprise an eccentrically driven orbiting gear set.

18. Apparatus as in claim 17, for applying torque to a nut of a wheel having a central axle hole rim with an outside diameter and a next rim with an inside diameter and concentric with said axle hole rim, wherein said output means bore is located on said second gear member, and said bracing means comprises said housing including a lower portion having an external configuration, and a tool having a bore with an internal configuration to match the external configuration of said housing lower portion and having an external configuration to simultaneously match curvatures of said outside diameter of said axle hole rim and said inside diameter of said next rim.

19. Apparatus as in claim 17, for applying torque to a nut of a lug having an end with a non-circular external cross-sectional configuration, wherein said output means bore is located on said housing, and said bracing means comprises a bore in said second gear member having a non-circular internal cross-sectional configuration to match the external configuration of said lug end.

* * * * *